United States Patent [19]

Menchetti et al.

[11] Patent Number: 4,837,988

[45] Date of Patent: Jun. 13, 1989

[54] UNIVERSAL SECONDARY STUD

[75] Inventors: Robert J. Menchetti, Buffalo; Richard P. Weir, Kenmore, both of N.Y.

[73] Assignee: National Gypsum Company, Dallas, Tex.

[21] Appl. No.: 150,121

[22] Filed: Jan. 29, 1988

[51] Int. Cl.[4] ..... A47G 29/02; E04B 2/30

[52] U.S. Cl. ..... 52/36; 52/281; 52/481; 52/486; 52/488; 52/490

[58] Field of Search ..... 52/490, 303, 481, 486, 52/490, 479, 488, 483, 474, 272, 36, 281

[56] References Cited

U.S. PATENT DOCUMENTS

| | | | |
|---|---|---|---|
| 1,876,528 | 9/1932 | Walters | 52/481 |
| 2,042,290 | 5/1936 | Barrett | 52/488 |
| 2,430,654 | 11/1947 | Volge | 52/481 |
| 2,530,465 | 11/1950 | Harding | 52/773 |
| 2,554,418 | 5/1951 | Mortenson | 52/775 |
| 3,429,090 | 2/1969 | Metelnick | 52/481 |

*Primary Examiner*—Michael Safavi

*Attorney, Agent, or Firm*—Laird F. Miller; Robert F. Hause

[57] ABSTRACT

A secondary vertical stud or furniture channel for mounting against one side of a plurality of vertically spaced upwardly opening horizontal channels in a hollow partition wall framework, with slots in the secondary stud for engaging the upwardly extending flanges of the horizontal channels. The secondary studs are able to be freely located at any position along the length of the wall, for supporting wall furniture where desired, for locating a perpendicularly extending second partition wall wherever desired, or for receiving fasteners or adding stability to the wall framework wherever desired, by very simple installation procedures.

6 Claims, 3 Drawing Sheets

UNIVERSAL SECONDARY STUD

BACKGROUND OF THE INVENTION

This invention relates to a vertical, inwardly opening channel having mounting means for attachment to horizontal channels and providing functions similar to a vertical stud, at any desired location along the horizontal extent of a hollow wall.

Occasionally a need arises for special means in a hollow wall to provide the functions of a vertical metal stud, other than those functions provided for by the original basic wall supporting studs which were installed during the original erection of the wall framework. Examples of such need are when a new wall is to be added in a building to be adjoined, perpendicularly, to an existing wall at a location in the existing wall where there is no original stud, or when wall supported furniture is to be mounted on a location in the wall where there is no original stud, or when a special U-shaped vertical stud with two parallel spaced webs is used and a surface to screw into is needed on the stud open side. Secondly, a need arises occasionally for a wall furniture supporting vertical channel of greater stiffness than one which is fastened to the outer surface of horizontal channels.

Still further, a vertical furniture channel is desired which can be erected more rapidly than the prior furniture channels which are screw attached to a plurality of parallel horizontal channels, and, still further, one which does not weaken the horizontal channels by penetrating the flanges of the horizontal channels with screws, as is the situation with the erection of the prior furninture channels of U.S. Pat. No. 4,651,484.

SUMMARY OF THE INVENTION

The present invention is directed to a novel vertical channel having means for being hung on preexisting horizontal channels which were a part of the original wall framework. The novel channels include inwardly extending slots formed to receive a flange of each of a plurality of horizontal channels, whereby the novel vertical channel is supported and held in place by the engagement with the horizontal channels. These inwardly extending slots may be located in the relatively wide inwardly extending flanges of the vertical channel or they may be located in a short section of wide flanged channel which is affixed, as by welding, within a relatively narrow flanged vertical channel.

It is an object of the present invention to provide a universal secondary stud which is essentially an inwardly directed vertical channel with means for easily hanging the vertical channel on a plurality of preexisting upwardly opening horizontal channels.

It is a further object to provide such a secondary stud which may be located at any desired location along the length of a wall, irrespective of the location of the original vertical studs used in erecting the wall framework, to provide certain of the functions of a vertical stud at completely optional selected locations, in a manner which is substantially superior to the prior use of furniture channels.

BRIEF DESCRIPTION OF THE DRAWINGS

These and other objects and advantages will be more readily apparent when considered in relation to the preferred embodiments, as set forth in the specification, and shown in the drawings, in which.

DESCRIPTION OF THE PREFERRED EMBODIMENT

Figure 1:
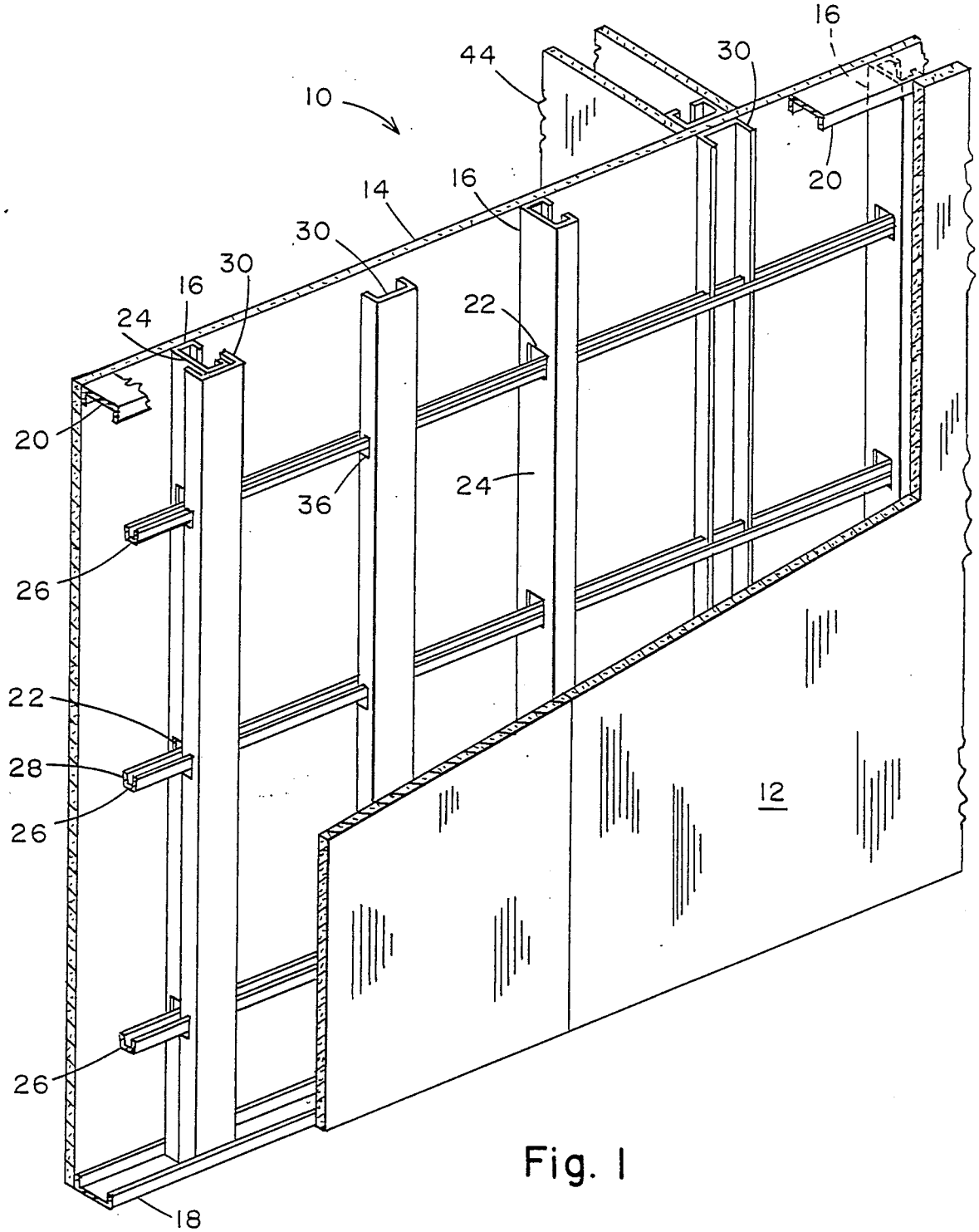
FIG. 1 is an isometric view of a partition wall, portions being broken away, having furniture channels embodied therein in accordance with the invention.

Referring to FIG. 1, a partition wall 10 is shown, having a first side 12 and a second side 14. Wall 10 includes primary vertical metal studs 16 mounted between a floor runner 18 and a ceiling runner 20. Each primary stud 16 has a plurality of openings 22 in the web 24, which are located in equally spaced apart positions of 29 inches, center to center. The web 24 has a horizontal extent which is perpendicular to the general plane of the partition wall 10.

Upwardly opening elongate metal reinforcing channels 26, having a U-shaped cross section, with upwardly and outwardly extending flanges 28, are located extending horizontally through a plurality of openings 22 in primary studs 16, resting on the bottoms of the openings 22, with the topmost reinforcing channel 26 located 20 inches from the ceiling runner 20.

A plurality of vertically extending secondary studs or furniture channels 30 are mounted on each side of the plurality of horizontal reinforcing channels 26.

Figure 2:
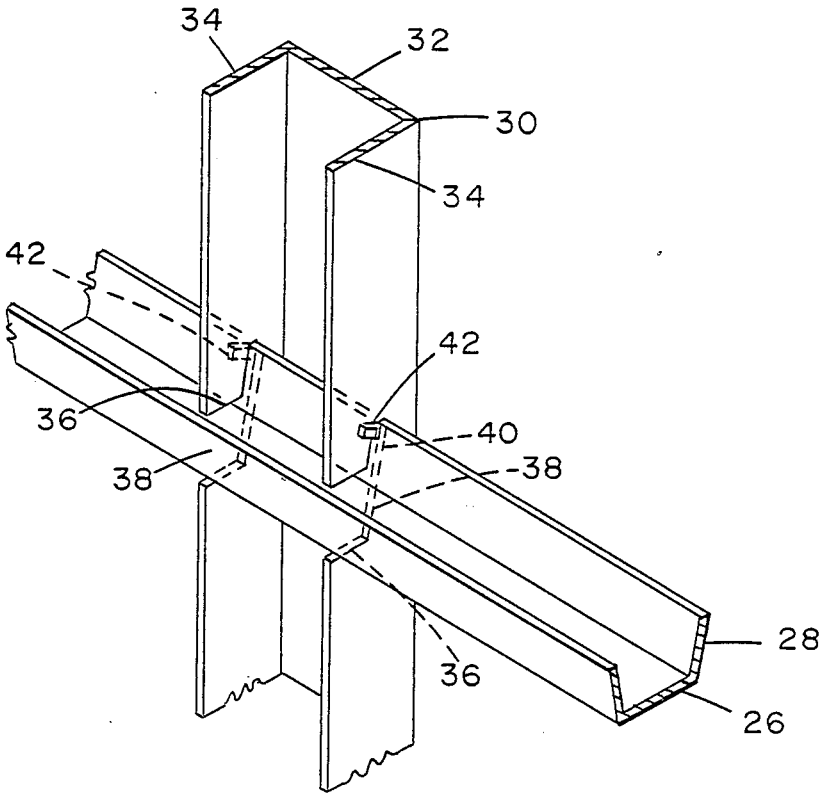
FIG. 2 is an enlarged isometric view of a portion of one of the furniture channels of FIG. 1 engaged on one of the horizontal channels of FIG. 1.

Referring to FIG. 2, a furniture channel 30 is shown, including a web 32 and a pair of wide, inwardly directed flanges 34. An upwardly and inwardly directed slot 36 extends about half way through the width of each flange 34, shaped to receive an upwardly and outwardly extending flange 28 of the horizontal channel 26. Slots 36 are located at spaced apart locations in the flanges 34, for engagement with each of the three horizontal channels, as shown in FIG. 1.

The slots 36 include a relatively wide mouth section 38 and a relatively narrow upwardly extending flange recieving inner section 40. A bendable tab 42 is formed at the innermost end of inner section 40 to permit adjustment of the depth of inner section 40. This construction of the slots 36, with the wide mouth section 38, permits the use of very wide flanges 34. With very wide flanges 34, the channel 30 is able to function as a very stable secondary stud, in the overall structure. With the very stable channel 30 being used, a second partition wall 44 is able to be constructed perpendicular to partition wall 10, adjoined to wall 10 at a channel or secondary stud 30, as shown in FIG. 1, midway between two studs 16. The ability to adjust the depth of inner section 40 allows the web 32 to be located coplanar with the primary vertical studs 16 or be further out, in walls where secondary studs are also disposed over primary studs.

Figure 3:
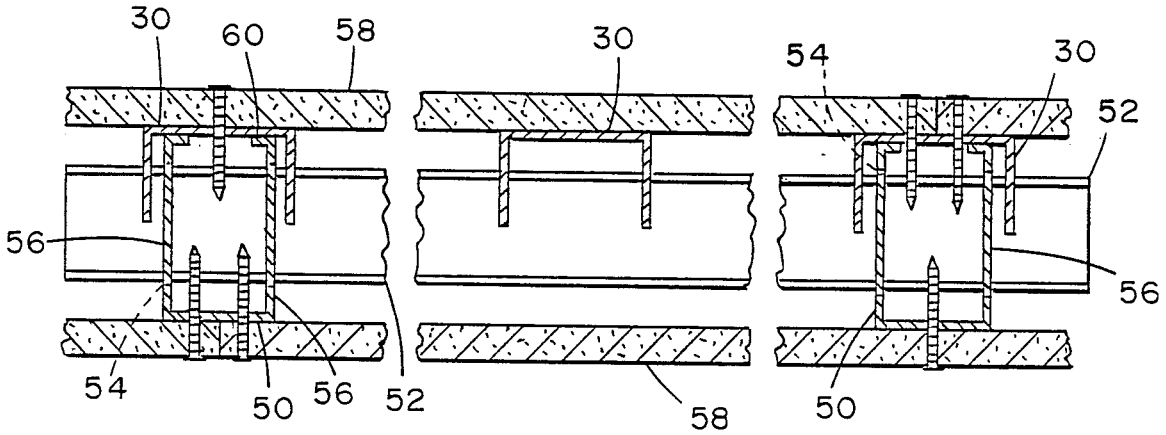
FIG. 3 is a horizontal sectional view of a partition constructed originally with U-shaped studs, with a secondary stud in accordance with the invention disposed over the open side of the U-stud for the screw attachment thereto of wallboard.

Referring to FIG. 3, there is shown a horizontal sectional view of a wall constructed with U-shaped studs 50 and relatively short sections of horizontally extending channel 52 disposed through two openings 54 in the two webs 56 of the U-shaped studs. The U-shaped stud 50, with two webs 56 and two openings 54 permit the use of short horizontal channels in wall frame construction, however, since there is occasional need to screw attach the wallboard 58 to the two sides of the stud 50, the additional use of a channel or secondary stud 30 over the open side 60 of stud 50 provides the desired screwable surface to which wallboard 58 can be screw attached. The channel or secondary stud 30 is hung on the short channels 52 in the same manner as is shown hung on the channel 26 of FIG. 1.

Figure 4:
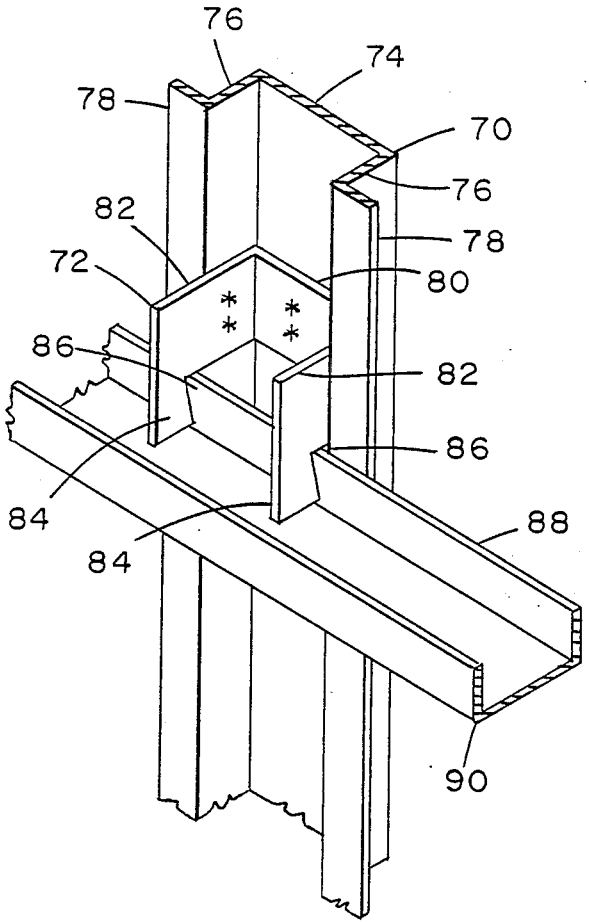
FIG. 4 is an isometric view of a modified form of a furniture channel engaged on a horizontal channel.

In FIG. 4, there is shown a modification of the invention, in which a hat shaped furniture channel 70 has a short section of inner channel 72 welded inside thereof. The hat shaped furniture channel 70 includes a web 74, two narrow inwardly directed flanges 76 and two sidewardly directed flanges 78. The short inner channel 72, welded inside of the hat shaped channel 70, includes a web 80 and two wide inwardly directed flanges 82. The two wide flanges 82 are each shaped to include a downwardly extending tab 84, which, in combination with the adjacent sideward flange 78, forms a narrow slot 86 for receiving therewithin a flange 88 of a horizontal channel 90.

Figure 5:
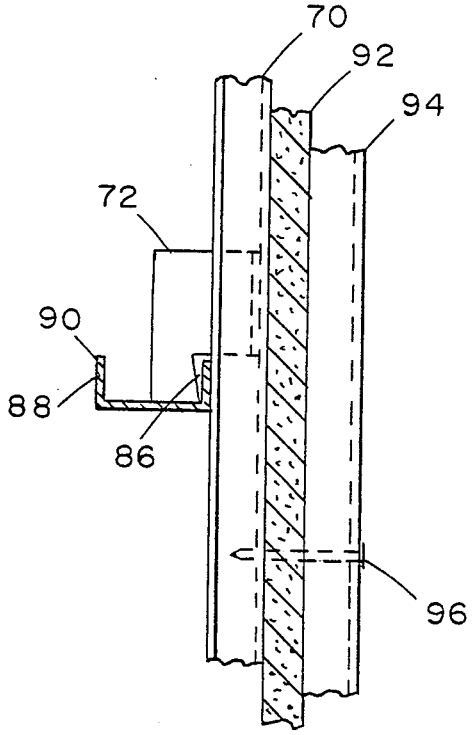
FIG. 5 is a vertical sectional view of the furniture channel of FIG. 4, with wallboard disposed over the furniture channel and a wall furniture bracket affixed by screws extending through the wallboard into the furniture channel.

FIG. 5 shows a vertical sectional view of the furniture channel 70, supported on horizontal channel 90, further including a section of wallboard 92 and a wall furniture bracket 94 screw attached through wallboard 92 into furniture channel 70, by screws 96.

Figure 6:
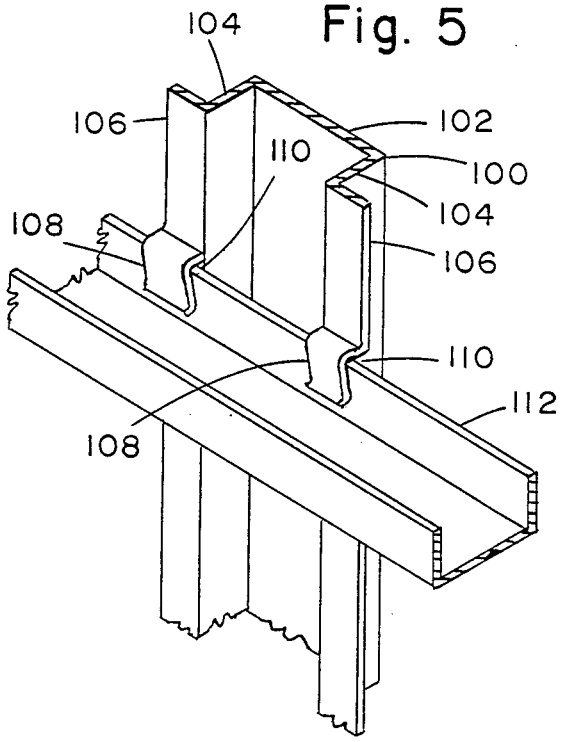
FIG. 6 is an isometric view of a further modified form of the furniture channel of the invention, engaged on a horizontal channel.

FIG. 6 shows a further modification of the invention, wherein a hat shaped furniture channel 100 includes a web 102, two inwardly directed flanges 104, two sidewardly directed flanges 106 and a short tab 108 which is partially cut from each flange 106 and bent in a direction away from web 102 and then bent substantially parallel to web 102, to form a slot 110, between tab 108 and inward flange 104. Tabs 108 are formed at spaced positions along the length of channel 100, for engagement with a plurality of horizontal channel flanges 112.

Having completed a detailed disclosure of the preferred embodiments of our invention so that those skilled in the art may practice the same, we contemplate that variations may be made without departing from the essence of the invention or the scope of the appended claims.

We claim:

1. A partition wall comprising at least one vertical secondary stud for use on one side of a wall framework comprising an inner portion and an outer portion, an elongate web in said outer portion with a pair of opposed elongate side edges, a pair of elongate inwardly directed flanges extending perpendicularly inwardly from each said side edge of said elongate web and means for supporting said secondary stud on a plurality of upwardly opening, spaced apart, horizontal channels, said means for supporting said secondary stud comprising a slot formed in said secondary stud, said slot being located in said inner portion of said secondary stud and extending upwardly forming a narrow inner section, said slot being suitable for the reception of and retention by an upwardly extending flange of an upwardly opening horizontal channel, vertical primary studs disposed at spaced parallel locations along the length of said partition wall, elongate webs in said vertical primary studs having a lateral extent which is perpendicular to the general plane of said partition wall, a plurality of openings at spaced vertical positions in said primary stud webs, and a plurality of horizontal channels, each said channel being disposed and supported in a plurality of said openings in said primary stud webs, said vertical secondary stud being disposed on one side of said plurality of horizontal channels with one upwardly extending flange of each said horizontal channel disposed in said slot of said vertical secondary stud, said wall further comprising wallboard affixed against said vertical primary studs and against said vertical secondary stud, wherein wall furniture is affixed against said wallboard by fastening means extending through the plane of said wallboard, said fastening means being mechanically affixed to said vertical secondary stud.

2. A partition wall as defined in claim 1 wherein said secondary stud consists essentially of said web and said inwardly directed flanges, with said slot being formed in each of said flanges.

3. A partition wall as defined in claim 2 wherein said slots in each of said two flanges each include a relatively wide mouth portion and a narrow upwardly extending flange receiving inner section terminating at an innermost end of each said slot, and a bendable tab at said innermost end of said inner section suitable for adjusting the depth of said inner section.

4. A partition wall comprising at least one vertical secondary stud for use on one side of a wall framework comprising an inner portion and an outer portion, an elongate web in said outer portion with a pair of opposed elongate side edges, a pair of elongate inwardly directed flanges extending perpendicularly inwardly from each said side edge of said elongate web and means for supporting said secondary stud on a plurality of upwardly opening, spaced apart, horizontal channels, said means for supporting said secondary stud comprising a slot formed in said secondary stud, said slot being located in said inner portion of said secondary stud and extending upwardly forming a narrow inner section, said slot being suitable for the reception of and retention by an upwardly extending flange of an upwardly opening horizontal channel, vertical primary studs disposed at spaced parallel locations along the length of said partition wall, elongate webs in said vertical primary studs having a lateral extent which is perpendicular to the general plane of said partition wall, a plurality of openings at spaced vertical positions in said primary stud webs, and a plurality of horizontal channels, each said channel being disposed and supported in a plurality of said openings in said primary stud webs, said vertical secondary stud being disposed on one side of said plurality of horizontal channels with one upwardly extending flange of each said horizontal channel disposed in said slot of said vertical secondary stud, wherein a second partition wall is abutted substantially perpendicularly to a portion of said first partition wall whereat said secondary vertical stud is located, said secondary partition wall having a primary vertical stud located at the end of said secondary partition whereat said second partition wall abuts said first partition wall, said second partition wall primary vertical stud being mechanically affixed to said adjacent secondary vertical stud of said first partition wall.

5. A partition wall as defined in claim 4 wherein said secondary stud consists essentially of said web and said inwardly directed flanges, with said slot being formed in each of said flanges.

6. A partition wall as defined in claim 5 wherein said slots in each of said two flanges each include a relatively wide mouth portion and a narrow upwardly extending flange receiving inner section terminating at an innermost end of each said slot, and a bendable tab at said innermost end of said inner section suitable for adjusting the depth of said inner section.

* * * * *